US010873155B2

(12) United States Patent
Haemmerling

(10) Patent No.: US 10,873,155 B2
(45) Date of Patent: Dec. 22, 2020

(54) PLUG CONNECTOR

(71) Applicant: HARTING Electronics GmbH, Espelkamp (DE)

(72) Inventor: Sergej Haemmerling, Bohmte (DE)

(73) Assignee: HARTING ELECTRONICS GMBH

( * ) Notice: Subject to any disclaimer, the term of this patent is extended or adjusted under 35 U.S.C. 154(b) by 164 days.

(21) Appl. No.: 16/304,028

(22) PCT Filed: Jun. 8, 2017

(86) PCT No.: PCT/DE2017/100483
§ 371 (c)(1),
(2) Date: Nov. 21, 2018

(87) PCT Pub. No.: WO2017/211358
PCT Pub. Date: Dec. 14, 2017

(65) Prior Publication Data

US 2020/0321728 A1 Oct. 8, 2020

(30) Foreign Application Priority Data

Jun. 10, 2016 (DE) ..... 10 2016 110 717

(51) Int. Cl.
*H01R 13/627* (2006.01)
*H01R 13/639* (2006.01)
*H01R 24/86* (2011.01)

(52) U.S. Cl.
CPC ..... *H01R 13/6277* (2013.01); *H01R 13/639* (2013.01); *H01R 24/86* (2013.01)

(58) Field of Classification Search
CPC ..... H01R 13/6277; H01R 13/639; H01R 9/0524; H01R 13/5202; H01R 13/6392; H01R 13/622; H01R 43/26; H01R 4/4863; F16L 37/1215; H01B 17/583
USPC ..... 439/352
See application file for complete search history.

(56) References Cited

U.S. PATENT DOCUMENTS

| | | | | |
|---|---|---|---|---|
| 3,452,316 | A | 6/1969 | Panek et al. | 339/45 |
| 4,929,189 | A | 5/1990 | Sekiguchi | 439/352 |
| 7,850,472 | B2 | 12/2010 | Friedrich et al. | 439/256 |

(Continued)

FOREIGN PATENT DOCUMENTS

| | | | |
|---|---|---|---|
| DE | 102005057444 | 3/2007 | H01R 13/627 |
| DE | 102007009947 | 9/2008 | H01R 13/502 |
| DE | 102012111408 | 10/2013 | H01R 13/639 |

OTHER PUBLICATIONS

International Preliminary Report on Patentability issued in application PCT/DE2017/100483, dated Dec. 20, 2018 (10 pgs).

(Continued)

*Primary Examiner* — Jean F Duverne
(74) *Attorney, Agent, or Firm* — Hayes Soloway P.C.

(57) ABSTRACT

A plug connector has a main body, an actuating element, and a contact carrier accommodated in the main body. By pulling on the actuating element against the plugging direction of the plug connector, a locking connection to a mating plug connector can be released and the plug connector can be removed from the mating plug connector. The spring strength of locking arms that enable the locking connection to a mating plug connector can be adjusted by the actuating element. As a result of a spring strength reduced in such a way, the locking connection can be released.

13 Claims, 2 Drawing Sheets

(56) References Cited

U.S. PATENT DOCUMENTS

| | | | | |
|---|---|---|---|---|
| 7,972,158 | B2 * | 7/2011 | Wild | H01R 13/6277 439/257 |
| 8,337,229 | B2 * | 12/2012 | Montena | H01R 43/26 439/322 |
| 9,071,019 | B2 * | 6/2015 | Burns | H01R 13/639 |
| 9,147,955 | B2 * | 9/2015 | Hanson | H01R 4/4863 |
| 9,147,963 | B2 * | 9/2015 | Balcer | H01R 9/0524 |
| 9,431,763 | B2 * | 8/2016 | Chapel | H01R 13/6392 |
| 9,478,911 | B2 | 10/2016 | Friesen | H01R 13/639 |
| 9,893,466 | B2 * | 2/2018 | Wu | H01R 13/639 |
| 9,923,302 | B2 * | 3/2018 | Friesen | H01R 13/5202 |
| 9,976,683 | B2 * | 5/2018 | Blanchard | F16L 37/1215 |
| 10,622,749 | B2 * | 4/2020 | Watkins | H01R 13/622 |
| 10,670,175 | B2 * | 6/2020 | Klein | F16L 37/0985 |
| 2004/0014350 | A1 | 1/2004 | McMullen et al. | 439/350 |
| 2010/0105235 | A1 * | 4/2010 | Friedrich | H01R 13/622 439/321 |
| 2015/0047898 | A1 * | 2/2015 | Sagdic | H01B 17/583 174/657 |

OTHER PUBLICATIONS

European Office Action (w/machine translation) issued in application No. 17 737 466.7, dated Oct. 22, 2019 (9 pgs).
German Office Action (w/machine translation) issued in application No. 10 2016 110 717.4, dated Feb. 2, 2017 (9 pgs).
International Search Report and Written Opinion issued in application PCT/DE2017/100483, dated Aug. 25, 2017 (22 pgs).
Chinese Office Action (w/translation) issued if application No. 201780035558.5, dated Sep. 27, 2019 (14 pgs).
Chinese Office Action (w/machine translation) issued in application No. 201780035558.5, dated Mar. 25, 2020 (12 pgs).

* cited by examiner

PLUG CONNECTOR

BACKGROUND OF THE INVENTION

Plug connectors are required for connecting preferably electrical lines and cables reversibly to one another. In this case, a reliable electrical and mechanical connection of the mating plug parts must be ensured. A durable mechanical latching of the mating plug parts is equally as important as the total connection and contacting of internal contacts.

A generic plug connector of this type can refer both to electrical and optical, pneumatic or hydraulic plug connectors. The invention presented can be assigned to any type of plug connector.

In addition to the mechanical connection of the plug connectors, the release of the connection must also be ensured. In this case, the mechanical latching connection must be released completely without destroying components of the locking mechanism or the plug connectors.

These contacting and de-contacting procedures of plug connectors and the locking mechanism present on the plug connectors must be capable of being repeated a plurality of times without influencing the quality of the locking connection and contacting.

PRIOR ART

DE 10 2012 111 408 B3 discloses a mechanism for locking a plug connector to a mating plug part. In this case, the locking mechanism possesses two types of locking means. A primary locking element, which is suitable for the locking connection of the mating plug part, and a secondary locking element which is suitable for mutual locking with the primary locking element. In this case, the secondary locking element locks the primary locking element in the locked state of the locking mechanism, and the primary locking element locks the secondary locking element in the unlocked state of the locking mechanism. The mechanism is locked automatically as a result of the contacting of the mating plug part, and unlocked by actuating the secondary locking element—constructed as an actuator.

U.S. Pat. No. 4,929,189 A discloses a rod-shaped plug connector which is small in design and has a locking mechanism by means of which it is automatically locked with the associated plug connector when it is plugged therein. In this case, the locking mechanism has many individual constituent parts.

The disadvantage of these types of solution known from the prior art is the large number of mechanical parts. Many of the known solutions have many small parts, which together form a very complex, fault-prone device. Devices having many individual parts are naturally more prone to faults and failure.

SUMMARY OF THE INVENTION

The invention is therefore based on the object of providing a further type of plug connector in order to increase the variety of such plug connectors with locking mechanisms. In this case, the plug connector should have as few individual mechanical parts as possible and the reliability of the device should be increased and fault probability of the device should therefore be reduced.

The invention relates to a plug connector for establishing contact with a mating plug connector. The plug connector is preferably provided for establishing a connection and contact with a plug socket, a so-called receptacle. In this case, the receptacle is designed as a passive component to which the plug connector according to the invention can latch.

The plug connector has a base body, which forms a plug face on one side. The plug face is configured for establishing contact with the receptacle and determines the type/variety of plug connector. Depending on the embodiment, these can be formed differently and can differ in terms of type, size and number of contacts. An actuating means is arranged on the base body. The actuating means preferably surrounds the base body and can be displaced a defined distance along the base body. The plug connector moreover has at least one latching arm, and a contact carrier arranged in the base body. Depending on the design, the contact carrier and the base body can also be formed in one part and comprise one component.

The at least one latching arm is formed from a mechanically flexible material and can likewise be formed in one part with the base body. However, the invention also includes a form as a separate component, which is mounted on the base body. The latching arm is able to execute a pivotal movement owing to its flexibility. In this case, the latching arm forms a free end which can be pivoted away from the base body and pivoted toward the base body. The pivotal movement of the latching arm is preferably radially configured. That is to say, in the case of a circular plug connector, for example, the pivotal movement is away from the axis of symmetry of the plug connector.

The free end of the latching arm is aligned toward the plug face of the plug connector. Therefore, the latching arm can latch with a receptacle which is inserted into the region of the plug face. The at least one latching arm therefore serves for the mechanical latching of the plug connector with the receptacle. At least three latching arms are preferably provided on the plug connector. Especially in the case of circular plug connectors, the arrangement of three latching arms over the circumference is particularly advantageous since a particularly uniform force distribution is thereby ensured. However, an embodiment having two, four, five or more latching arms is also conceivable and, depending on the application, expedient.

According to the invention, the plug connector has at least one spring arm. In this case, the spring arm is aligned parallel to the latching arm and abuts against this. In this case, the spring arm can abut against the latching arm over a certain length or only touch the latching arm at certain points. The spring arm preferably abuts against the latching arm in the pivotal direction. The spring force of the latching arm is increased by the spring arm which abuts against the latching arm. As a result of its material properties, the latching arm therefore has a specific spring constant which produces a spring force during a pivotal movement. As a result of the spring arm abutting against the latching arm, the spring force is increased by the spring force of the spring arm when the latching arm pivots toward the spring arm and pivots this latter with it.

The spring arm is mechanically connected to the actuating means. A special embodiment provides for forming the spring arm in one part with the actuating means. As a result of the mechanical connection of the spring arm and the actuating means, the spring arm, like the actuating means, can be moved along the plug connector axis. It is thus possible to adjust the position of the spring arm on the latching arm and alter it as desired. The spring force, which is the result of the sum of the rigidity of the latching arm and spring arm, differs depending on how far the spring arm abuts along the free end of the latching arm. If the spring arm abuts further along the free end of the latching arm, the resultant spring force is higher than when the spring arm abuts against the latching arm further away from the free end.

A latching hook is expediently provided at the free end of the latching arm. The latching hook serves for latching the plug connector with the receptacle. As a result of the latching hook latching behind a corresponding recess or edge on the receptacle, the plug connector can be prevented from being withdrawn from the receptacle.

In this case, the latching hook has a latching flank and an insertion chamfer. The insertion chamfer points in the plug-in direction, i.e. facing toward the plug face and the receptacle. As a result of a very shallow slope, a pivotal movement of the latching arm can also be generated under a high force. The slope of the insertion chamfer is preferably configured such that the latching arm can be deflected with the abutting spring arm. Therefore, the plug connector can be latched onto a receptacle with our without an abutting spring arm. A correspondingly shallow slope allows the deflection of the latching arm, so that the latching arm can latch on the receptacle.

The latching flank is aligned in the opposite direction at the rear of the insertion chamfer. The latching flank can thus latch against a corresponding flank or an undercut on the receptacle. In the present invention, however, the latching flank is not necessarily aligned perpendicularly to the plug-in direction of the plug connector, as is known from the prior art. The latching flank and the corresponding mating piece on the receptacle are designed such that, upon applying a corresponding force for withdrawing the plug connector from the receptacle, a slight force is generated for deflecting the latching arm. In this case, however, the force generated is considerably lower than the force which is generated by the insertion chamfer when the plug connector is plugged onto a receptacle. The force generated by the latching flank during the withdrawal from the receptacle is specifically great enough to enable the latching arm to be deflected, but lower than the force which is required to deflect the latching arm with the abutting spring arm.

The plug connector can therefore assume two states: a first, locked state and a second, unlocked state. In this case, the actuating means is in a first, locked position in the first, locked state and in a second, unlocked position in the second, unlocked state. In this case, the first, locked position is further along the plug-in direction, i.e. facing further toward the plug face of the plug connector, than the second, unlocked position. The intention of this is that the spring arm abuts further along the free end of the latching arm in the first, locked position than in the second, unlocked position. The force for deflecting the spring arm is therefore greater in the first, locked state than in the second, unlocked state.

As a result of this design, the plug connector can be plugged onto a receptacle and latched therewith in both states, the locked state and the unlocked state. However, only in the second, unlocked state can the plug connector be withdrawn from the receptacle and de-contacted.

A further expedient embodiment provides that the plug connector has a spring. The spring is arranged between the base body and the actuating means and exerts a force on both. In this case, a forced movement of the actuating means into the first, locked position is brought about by the spring.

As a result of the features described by the invention, a novel plug connector is presented, which has a locking mechanism which comprises only a few movable parts. In this case, the reliability is very high and less prone to faults. The simple construction ensures durability of the plug connector, particularly in the event of frequent contacting and de-contacting procedures.

BRIEF DESCRIPTION OF THE DRAWINGS

The exemplary embodiment of the invention is illustrated in the drawings and will be explained in more detail below. The drawings show.

The figures contain partially simplified schematic illustrations. Identical reference signs are sometimes used for elements which are similar but possibly not identical. Varying views of similar elements could be drawn to different scales.

DETAILED DESCRIPTION OF THE INVENTION

Figure 1:
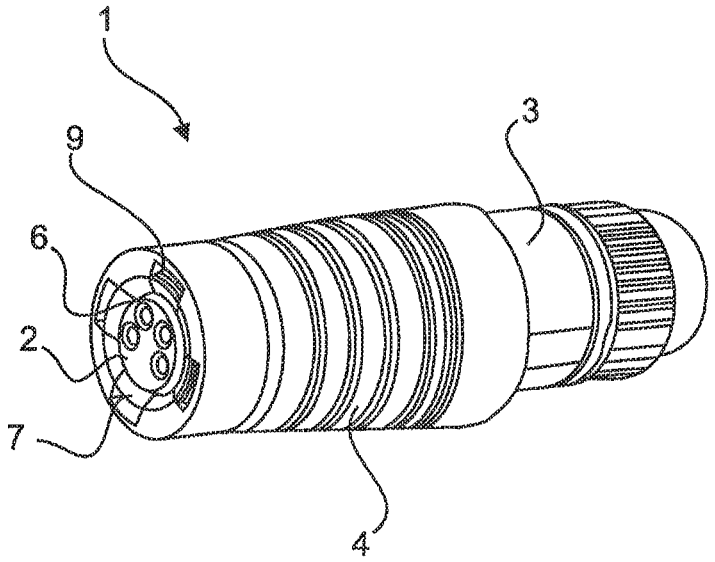
FIG. 1 a perspective illustration of a plug connector according to the invention in a first state.

FIG. 1 shows a perspective illustration of a plug connector 1 according to the invention in a first, locked state. The plug connector 1 is formed by a base body, which is enclosed by an actuating means 4. On the rear side, a cable gland 3 is provided on the plug connector 1. A cable can be inserted into the plug connector 1 and connected thereto via the cable gland 3. On the plug-in side, the plug connector 1 forms a plug face which enables access to a contact carrier 2 received in the plug connector 1.

The contact carrier 2 in the plug face of the plug connector 1 is surrounded by four latching arms 5, which enable a locking connection with a mating plug connector, a plug socket or so-called receptacle. The latching arms 5 each have a latching hook in the plug face of the plug connector 1. The latching hook is aligned inwards, toward the center axis of the plug connector 1, and forms an insertion chamfer 7 and a latching flank 6.

The latching flank 6 is aligned toward the rear side, the cable gland 3 of the plug connector 1. At the rear of the latching flank 6, the insertion chamfer 7 is aligned toward a mating plug connector. The latching arm 5 can be deflected via the insertion chamfer 7 upon connecting with a mating plug connector in order to latch with this latter.

A spring arm 9 is arranged on the outside of each latching arm 5. In this case, the spring arm 9 abuts against the latching arm 5 and touches it over its entire length.

Figure 2:
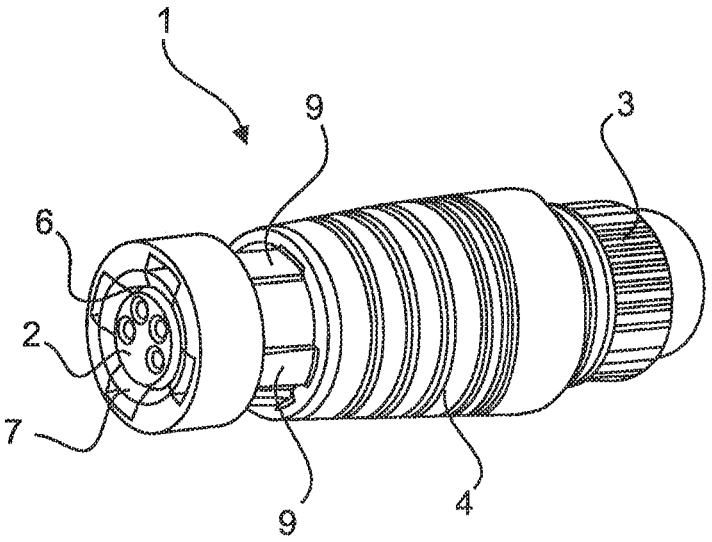
FIG. 2 a perspective illustration of the plug connector according to the invention in a second state.

FIG. 2 shows a perspective illustration of the plug connector 1 according to the invention in a second, unlocked state. In the second, unlocked state, the actuating means 4 is in a second, unlocked position. For this, the actuating means 4 is positioned further toward the cable gland 3 than in the first, locked position.

As a result of the second position, which is further remote from the plug-in side and the plug face of the plug connector 1, the spring arms 9 are likewise moved out of the plug face.

The spring arms 9 thus no longer abut so far along the free ends of the latching arms as in the first, locked position. Upon a radially outward pivotal movement, the spring force of the latching arms 5 is thus lower than in the first, locked state of the plug connector.

Figure 3:
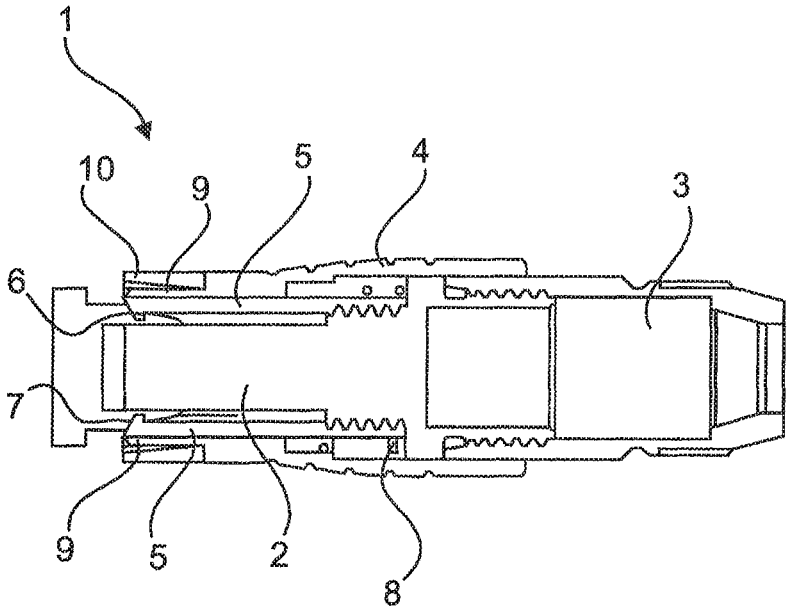
FIG. 3 a sectional illustration of the plug connector according to the invention in the first state.
Figure 4:
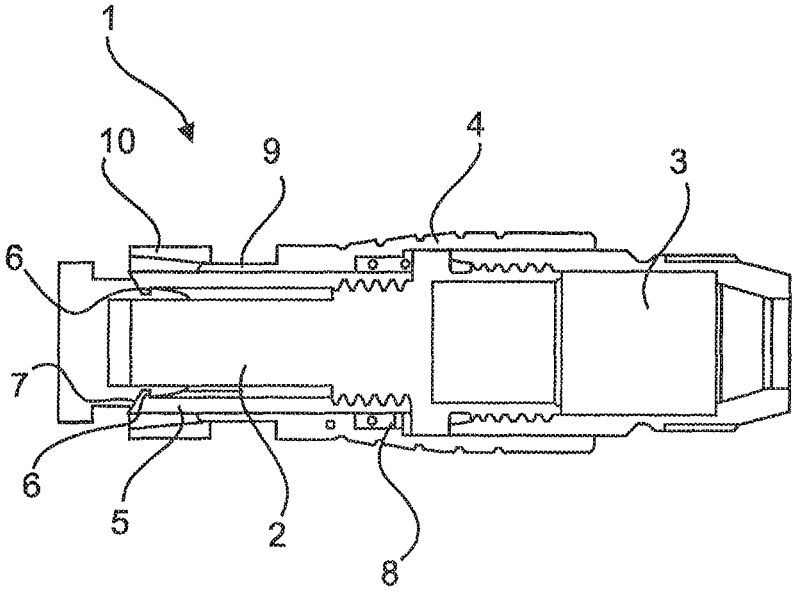
FIG. 4 a sectional illustration of the plug connector according to the invention in the second state.

The two states of the plug connector 1, the first, locked state and the second, unlocked state, are illustrated again in FIGS. 3 and 4. In this case, FIGS. 3 and 4 each show a sectional illustration of the plug connector 1 in the respective position.

In FIG. 3, it is possible to see the latching arms 5 which possess latching hooks on the plug-in side. The latching hooks each form an insertion chamfer 7 and a latching flank 6. A receptacle of a mating plug connector is latched against the latching flank 6. For the sake of clarity, the receptacle is only illustrated schematically.

A spring arm 9 abuts against the latching arms 5 in each case. The spring force of the latching arms 5 is increased by the abutting spring arm 9. An outer sleeve 10 of the base body, which surrounds the latching and spring arms 5, 9, is formed such that the latching and spring arms 5, 9 can still execute a pivotal movement together. In this special embodiment, the sleeve 10 and the latching arm 5 are formed in one part.

The spring arms 9 are formed in one part with the actuating means 4. The actuating means 4 is forced into the first, locked position by a spring 8, which is arranged between the actuating means 4 and the base body. As a result of this forced locking, it is ensured that, if necessary, the plug connector 1 is always locked and not unlocked.

FIG. 4 shows the plug connector 1 in the second, unlocked state. The actuating means 4 is moved into a rear, second, unlocked position. The spring arms 9 are thus removed from the region of the free ends of the latching arms 5. The spring force of the latching arms 5 is therefore considerably lower than in the first, locked position illustrated in FIG. 3.

In this state, the latching arms 5 can simply execute a pivotal movement and therefore release the latching connection with the receptacle. As a result of a slight chamfer of the latching flanks 6 or the corresponding region on the receptacle, the radial force which is therefore generated by withdrawing the plug connector 1 is sufficient for a pivotal movement of the latching arms 5. The force generated by the latching and spring arms 5, 9 in the state in FIG. 3 is too great to be overcome by a force.

The advantage of the invention consists in that the spring force of the latching arms 5 can be increased or reduced by the spring arms 9. As a result of a correspondingly advantageous configuration of the latching flanks 6 and associated mating flanks on the receptacle, reliable latching as well as intentional unlocking of the plug connector can therefore be established.

The invention claimed is:

1. A plug connector, having a base body with at least one side formed as a plug face, an actuator, which can be displaced along the base body, at least one latching arm and a contact carrier arranged in the base body, wherein the latching arm is flexibly formed and can execute a pivotal movement, and wherein the latching arm has a free end, which is aligned toward that side of the plug connector which is formed as a plug face, wherein at least one spring arm is formed on the plug connector, and wherein the spring arm abuts against the latching arm and is connected to the actuator, wherein a pivotal movement leading radially outwardly away from the center of the plug connector can be executed by the latching arm, wherein the spring arm abuts and touches against the latching arm along its entire length during this pivotal movement.

2. The plug connector as claimed in claim 1, wherein a latching hook having a latching flank and an insertion chamber is formed at the free end of the latching arm.

3. The plug connector as claimed in claim 2, wherein the spring arm abuts against the latching arm on the side of the latching arm which is remote from the latching hook.

4. The plug connector as claimed in claim 1, wherein the spring arm abuts against the latching arm in the region of the free end of the latching arm.

5. The plug connector as claimed in claim 4, wherein the spring arm is configured to be moved out of the region of the free end of the latching arm using the actuator.

6. The plug connector as claimed in claim 1, wherein the actuator is configured to assume a first, locking position and a second, unlocking position, wherein, in the first, locked position, the spring arm connected to the actuator abuts against the free arm further toward the free end than in the second, unlocked position.

7. The plug connector as claimed in claim 6, wherein the spring force of the latching arm is weaker in the second, unlocked position of the actuator than with the abutting spring arm in the first, locked position of the actuator.

8. The plug connector as claimed in claim 6, wherein the plug connector has a spring, which is arranged between the actuator and the base body, wherein the spring is configured to exert a force on the actuator and forces it into the first, locked position.

9. The plug connector as claimed in claim 2, wherein the spring arm abuts against the latching arm in the region of the free end of the latching arm.

10. The plug connector as claimed in claim 9, wherein the spring arm is configured to be moved out of the region of the free end of the latching arm by the actuator.

11. The plug connector as claimed in claim 3, wherein the spring arm abuts against the latching arm in the region of the free end of the latching arm.

12. The plug connector as claimed in claim 11, wherein the spring arm is configured to be moved out of the region of the free end of the latching arm by the actuator.

13. The plug connector as claimed in claim 7, wherein the plug connector has a spring, which is arranged between the actuator and the base body, wherein the spring is configured to exert a force on the actuator and forces it into the first, locked position.

* * * * *